US010597899B2

(12) United States Patent
Crandall et al.

(10) Patent No.: US 10,597,899 B2
(45) Date of Patent: Mar. 24, 2020

(54) FENCE BRACE SYSTEM ADAPTED FOR USE WITH FENCE POSTS POSITIONED ON A SLOPE

(71) Applicants: Fonda Crandall, Reno, NV (US); Joseph Crandall, Reno, NV (US)

(72) Inventors: Fonda Crandall, Reno, NV (US); Joseph Crandall, Reno, NV (US)

( * ) Notice: Subject to any disclaimer, the term of this patent is extended or adjusted under 35 U.S.C. 154(b) by 0 days.

(21) Appl. No.: 16/517,581

(22) Filed: Jul. 20, 2019

(65) Prior Publication Data

US 2019/0338555 A1 Nov. 7, 2019

Related U.S. Application Data

(63) Continuation-in-part of application No. 14/863,793, filed on Sep. 24, 2015, now Pat. No. 10,030,408, and a continuation-in-part of application No. 15/856,673, filed on Dec. 28, 2017.

(51) Int. Cl.
*E04H 17/14* (2006.01)

(52) U.S. Cl.
CPC ..... *E04H 17/1421* (2013.01); *E04H 17/1434* (2013.01); *E04H 2017/1452* (2013.01); *E04H 2017/1473* (2013.01)

(58) Field of Classification Search
CPC ..... E04H 17/1413; E04H 17/1417; E04H 17/1421; E04H 17/1426; E04H 17/143; E04H 17/1434; E04H 2017/1447; E04H 2017/1452; E04H 2017/1473
See application file for complete search history.

(56) References Cited

U.S. PATENT DOCUMENTS 4,526,348 A * 7/1985 Cammack ..... E04H 17/1413 256/65.06
5,186,571 A * 2/1993 Hentzschel ..... E04B 1/2608 256/65.06
6,290,214 B1 * 9/2001 DeSouza ..... E04H 17/1413 256/55
6,802,496 B1 * 10/2004 Preta ..... E04H 17/1413 16/253

FOREIGN PATENT DOCUMENTS

GB 677092 * 12/1949 ..... E04H 17/1413

* cited by examiner

*Primary Examiner* — Michael P Ferguson

(57) ABSTRACT

The present invention comprises a brace adapted to secure one or more fence rails to a fence post. The present invention brace may optionally be installed onto an existing fence or on a new fence. The invention includes a fence post brace member adapted to connect to two or more sides of a fence post and a fence rail brace member adapted to connect to two or more sides of a fence rail. The fence post brace member may form a vertical picket fastener slot for use in affixing a picket to the fence post. The fence post brace system may be adapted for use with one or more fence posts positioned on a slope.

16 Claims, 13 Drawing Sheets

FENCE BRACE SYSTEM ADAPTED FOR USE WITH FENCE POSTS POSITIONED ON A SLOPE

BRIEF DESCRIPTION OF THE INVENTION

The present invention relates to the field of fences. More particularly, the present invention relates to a system for providing structural support for fences including for fences having one or more fence posts positioned on a slope.

The present invention provides strength for building a new fence or repairing an existing fence. The fence would not need to be removed or modified to install the herein disclosed brace. Installation would be simple. The brace could be mass produced at low cost. The color and style of the brace could be easily adapted to match aesthetically with the fence and the surrounding area. The brace itself may be painted, stained, powder coated, colored, or made with a colored metal. The brace may also be built into a new fence. The present invention optionally includes embodiments adapted for fences with rectanguloid rails or for rectanguloid fence posts. The present invention may be optionally optimized for a fence with cylindrical fence posts. The present invention may also include an embodiment adapted to secure the corner pieces of the fence. In an additional optional embodiment, the present invention is adapted to secure a fence on a slope. The brace may be made of strong weather-resistant material such as steel, stainless steel, galvanized steel, aluminum, plastic, graphite, wood, or any composite material(s).

CROSS-REFERENCES TO RELATED APPLICATIONS

This non-provisional utility application is a continuation-in-part (CIP) application of the pending U.S. application Ser. No. 14/863,793 titled "Fence Brace System" and originally filed Sep. 24, 2015, and of the pending U.S. application Ser. No. 15/856,673 titled "Fence Brace System" and originally filed Dec. 28, 2017 (pending U.S. application Ser. No. 15/856,673 is a divisional application of pending U.S. application Ser. No. 14/863,793), which are hereby incorporated in their entirety by reference.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

Fence and fence structure are subject to damage due to high winds, torrential rains, heavy snowfall, vehicular accidents, termites, vandalism, earthquakes and falling trees and branches. The most common of these causes is high winds. Wind damages fences all around the world every year. Fences made of wood are especially susceptible to wind damage because wood is weakened by prolonged exposure to rain, snow, wind, and other elements. Despite the potential for damage, wood is still by far the most common residential fencing material in the United States. In 2007 alone, Americans put up 59,000 miles of wood fencing, enough to circle the globe twice. Wood is inexpensive and lightweight, and a wood fence can easily be shaped to give properties character and individuality. There are many styles, including linear post-and-rail and crisscrossing lattice, as well as myriad picket patterns and post-cap designs. And the wood may be painted or stained to match almost any landscape.

Fences could be built much stronger through the use of heavy materials such as steel and sturdy construction. However, this might drive the costs of the fence up above what is acceptable. As well, there are the aesthetic considerations discussed above. Also, it is unlikely that a property owner would replace an existing fence merely because of the possibility that it could be damaged by the elements.

There is an unmet need, therefore, for an inexpensive way to provide a fence with additional structural support. The need is especially great with respect to existing fences and with respect to wooden fences.

DETAILED DESCRIPTION OF THE INVENTION

Figure 2:
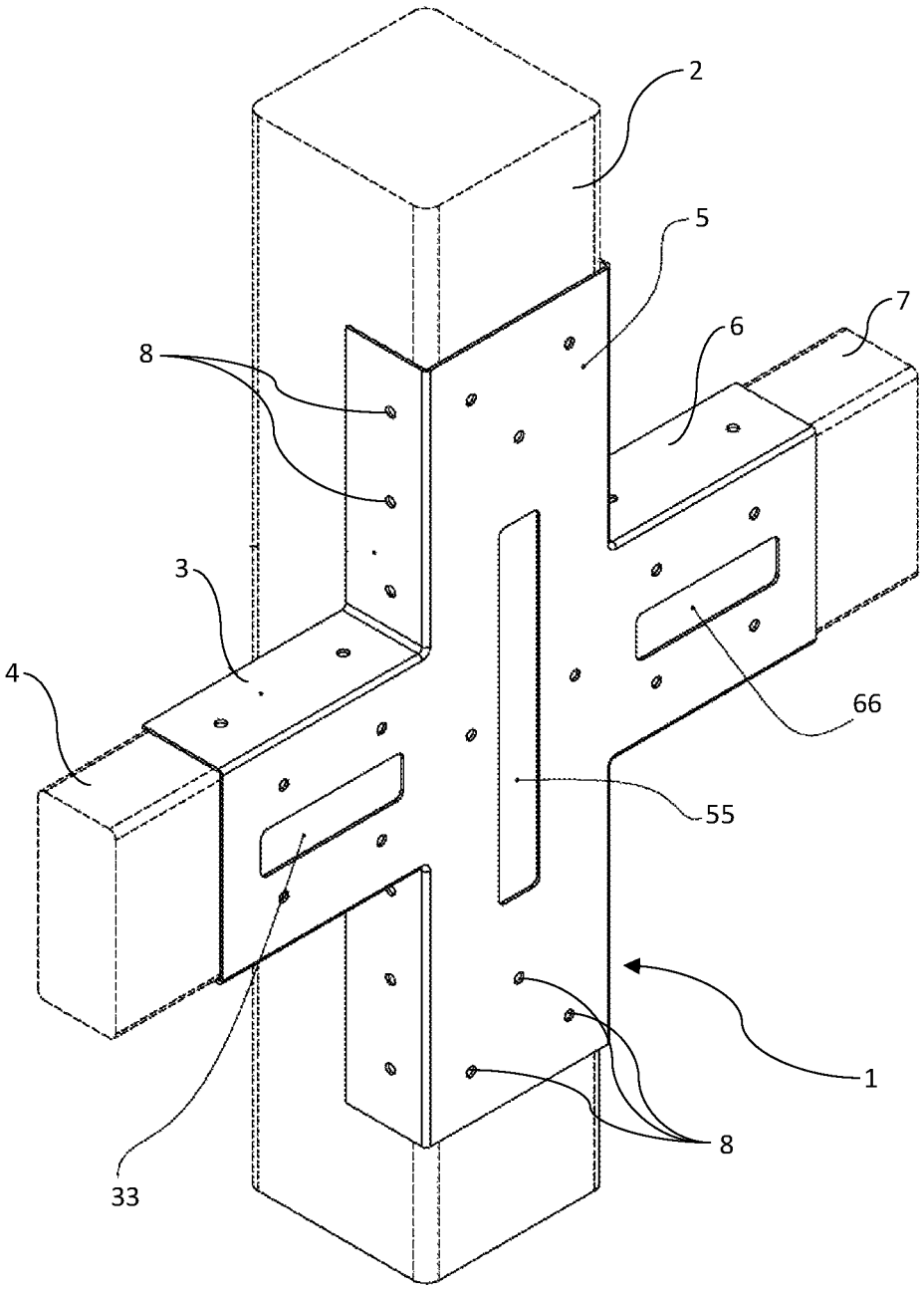
FIG. 2 illustrates an isometric view of a preferred embodiment of a fence brace, in accordance with the present invention.

In a preferred embodiment as illustrated in FIG. 2, the present invention comprises fence brace 1 for securing at least one fence rail 4 to fence post 2 including first fence rail brace member 3 adapted to connect to two or more sides of first fence rail 4. First fence rail brace member 3 may be fused to a first side of fence post brace member 5 wherein fence post brace member 5 is adapted to connect to two or more sides of fence post 2. The fence rail may be rectanguloid. As used herein, the term "rectanguloid" means a solid (3-dimensional) object which has six faces that are rectangles. It has the same cross-section along a length. As used herein, "rectanguloid" is the same as a rectangular prism. A rectanguloid may be though of as a 3-dimensional version of a rectangle or a square. The herein disclosed fence brace system may further include second fence rail brace member 6 fused to a second side of fence post brace member 5, wherein second fence rail brace member 6 is adapted to connect to two or more sides of second fence rail 7.

Fence brace 1 may include plurality of holes 8 thereby allowing fence post brace member 5 to be securely fastened to fence post 2 and thereby allowing first fence rail brace member 3 to be securely fastened to first fence rail 4 and second fence rail brace member 7 to be securely fastened to second fence rail 7. The plurality of holes may be referred to as screw-holes, nail holes, bolt holes, or other fastener holes. The plurality of holes may each receive a screw, a nail, a bolt, or an alternative type of fastener for securely connecting fence brace 1 to the fence post and/or the fence rail(s). The various figures illustrate the plurality of holes positioned in exemplary locations; those skilled in the art will recognize that the plurality of holes may be formed in various locations on the fence brace to provide the intended benefit of allowing secure attachment of the fence brace to the fence (the fence post and the fence rails).

Fence brace 1 may be formed of a strong weather-resistant material such as selected from the group consisting of steel, stainless steel, galvanized steel, aluminum, plastic, graphite, wood, or any composite material(s).

An embodiment of the present invention may further include one or more picket fastener slots for allowing one or more pickets (or boards) to be attached to the fence. For example, and as illustrated in FIG. 2 as a preferred embodiment, fence post brace member 5 forms vertical picket fastener slot 55, first fence rail brace member 3 forms first horizontal picket fastener slot 33, and second fence rail brace member 6 forms second horizontal picket fastener slot 66. This embodiment allows for attachment of a picket to fence post 2 through vertical picket fastener slot 55, attachment of a picket to first fence rail 4 through first horizontal picket fastener slot 33, and/or attachment of a picket to second fence rail 7 through second horizontal picket fastener slot 66. After fastening one or more pickets through the respective picket fastener slot, the herein disclosed fence brace is positioned in between the fence and the picket.

Figure 3:
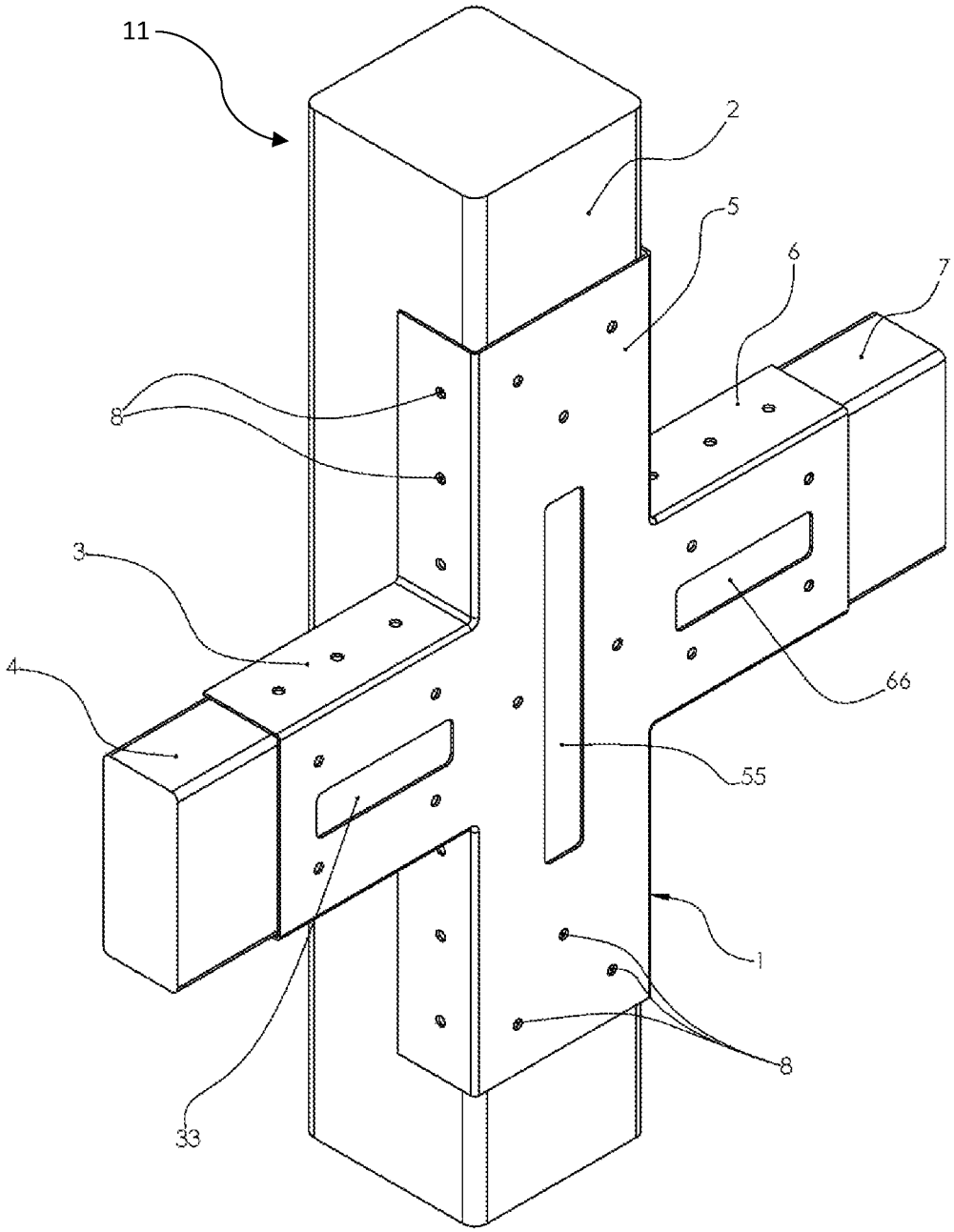
FIG. 3 illustrates an isometric view of a preferred embodiment of a fence assembly including a fence brace, a fence post, and a plurality of linearly disposed fence rails in accordance with the present invention.

Referring to FIG. 3, an embodiment of a fence brace assembly is illustrating comprising fence brace 1 attached to fence 11. Fence brace 1 includes fence post brace member 5 attached to fence post 2 and forming vertical picket fastener slot 55, first fence rail brace member 3 attached to first fence rail 4 and forming first horizontal picket fastener slot 33, and second fence brace member 6 attached to second fence rail 7 and forming second horizontal picket fastener slot 66.

Throughout this specification the fence brace system is mostly described as including a fence post brace member, a first fence rail brace member, and a second fence rail brace member. But for the present invention, fence post brace member 5 may alternatively be referred to as a pair of opposing upper and lower fence post flanges, each of the fence post flanges comprising a planer central wall and a pair of rearward-protruding side walls extending along opposing vertical longitudinally-extending edges of the central wall, the sidewalls of the upper fence post flange being vertically-aligned with the sidewalls of the lower fence post flange to define a pair of aligned channels for receiving the fence post therein. First fence rail brace member 3 and second fence rail brace member 6 may alternatively be referred to as a pair of opposing left and right fence rail flanges, each of the fence rail flanges comprising a planar central wall and a pair of rearward-protruding side walls extending along opposing horizontal longitudinally-extending edges of the central wall, the sidewalls of the left fence rail flange being horizontally-aligned with the sidewalls of the right fence rail flange to define a pair of aligned channels for receiving the fence rails therein.

Figure 1:
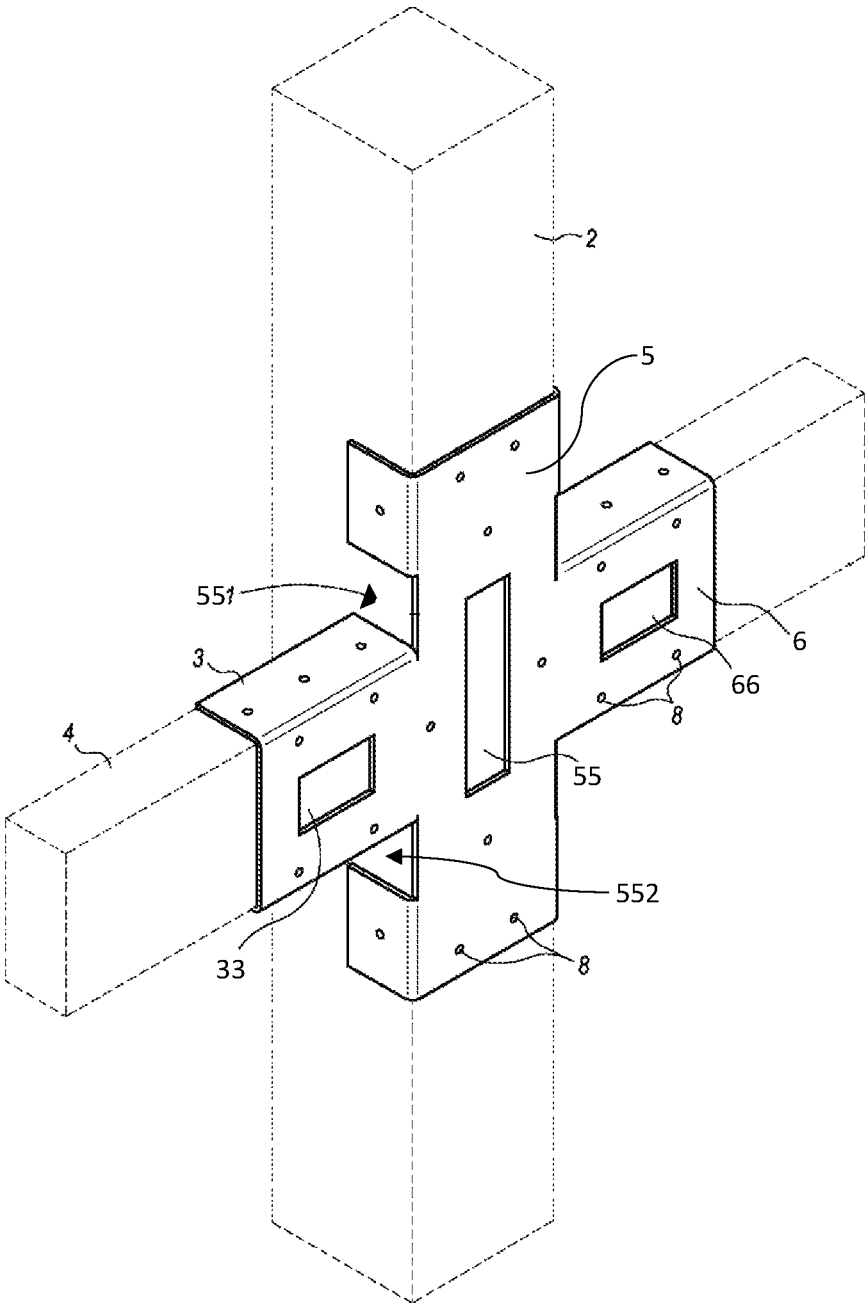
FIG. 1 illustrates an isometric view of an embodiment of a fence brace, wherein one or more cutouts are formed by the fence brace, in accordance with the present invention.

Referring to FIG. 1, an alternative embodiment of the herein disclosed fence brace system is illustrated wherein the rearward-protruding side walls of the opposing upper and lower fence post flanges do not extend all the way to the first and second fence rails. In this embodiment illustrated in FIG. 1, an upper flange cutout 551 is formed on each side of the upper flange and a lower flange cutout 552 is formed on each side of the lower flange. The embodiment illustrated in FIG. 2 differs in that the pair of rearward-protruding side walls extend fully towards first fence rail brace member and the second fence rail brace member so that the entire edge of the fence post (or a larger portion of the edge of the fence post) is covered by the rearward-protruding side walls.

Figure 4:
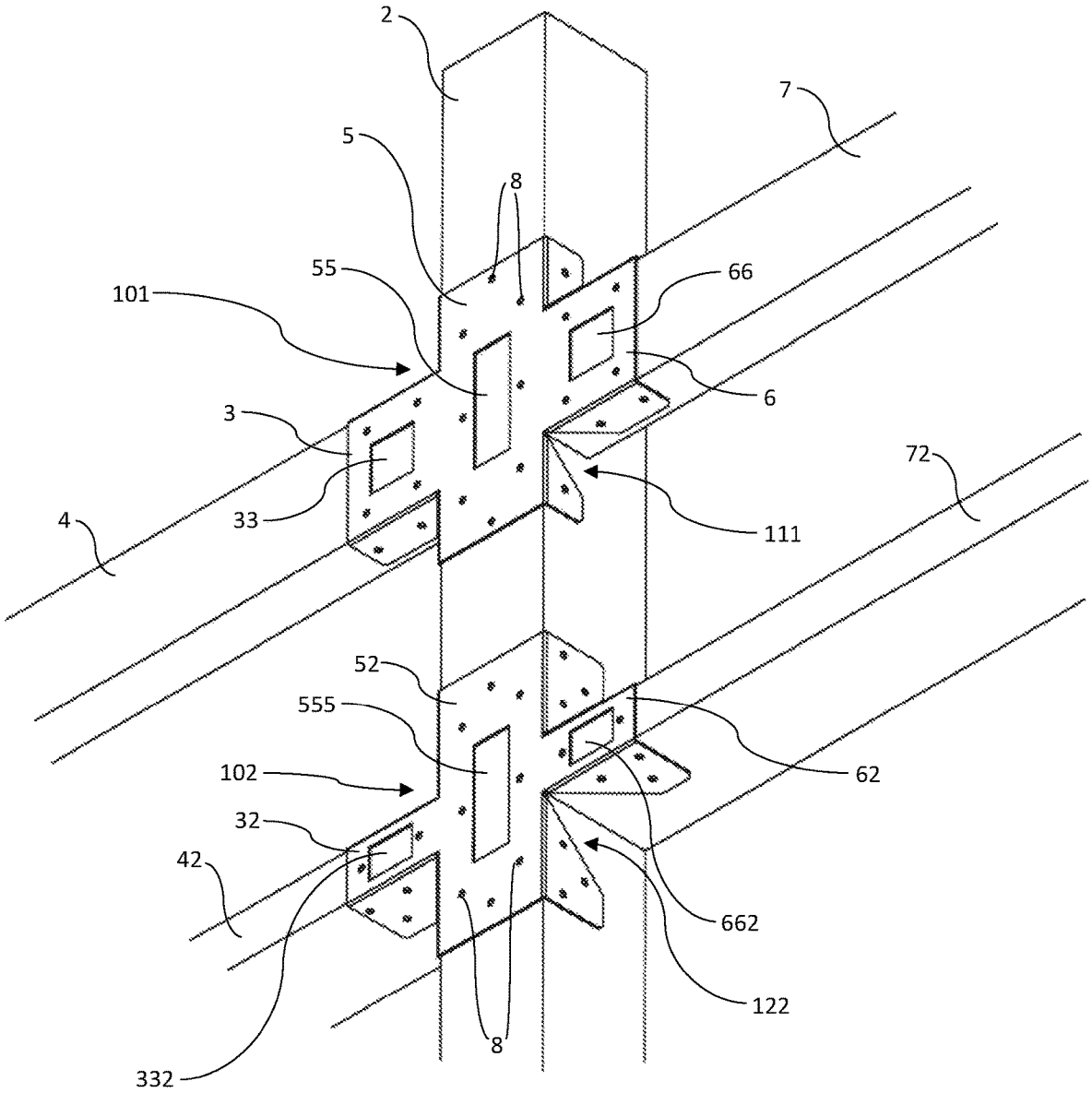
FIG. 4 illustrates an isometric view of two alternative embodiments of a fence assembly including a fence brace, a fence post, and a plurality of linearly disposed fence rails in accordance with the present invention, wherein the fence brace includes one or more angled or slanted edges formed by the rearward-protruding sidewalls.
Figure 5:
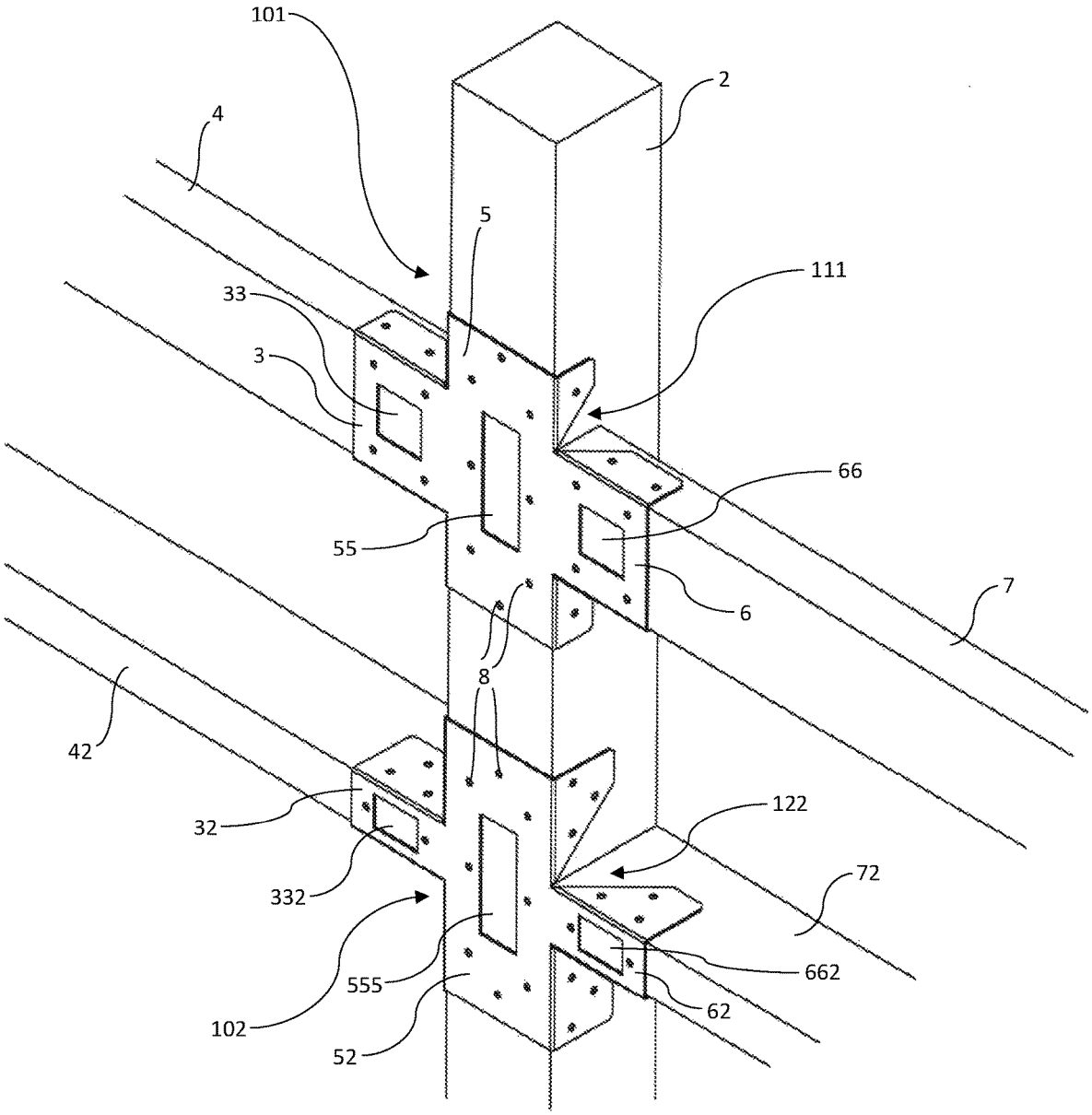
FIG. 5 illustrates an isometric view, from an alternative viewing angle, of two alternative embodiments of a fence assembly including a fence brace, a fence post, and a plurality of linearly disposed fence rails in accordance with the present invention, wherein the fence brace includes one or more angled or slanted edges formed by the rearward-protruding sidewalls.

Referring to FIG. 4 and FIG. 5, additional alternative embodiments of the herein disclosed fence brace system are shown that differ from the embodiment depicted in FIG. 1 by having one or more angled or slanted edges formed by the rearward-protruding sidewalls. In these alternative embodiments, one or more v-shaped cutouts may be formed by the rearward-protruding sidewalls.

Fence brace member 101 is adapted for use with first vertically oriented fence rail 4 and second vertically oriented fence rail 7. Fence rail 4 and fence rail 7 are referred to as vertically oriented because the respective fence rails are positioned so that they are taller than they are wide. Fence brace member 101 may include first fence rail brace member 3 forming first horizontal picket fastener slot 33, second fence rail brace member 6 forming second horizontal picket fastener slot 66, fence post brace member 5 forming vertical pocket fastener slot 55, one or more fastener holes 8, and may form one or more v-shaped cutout 111. V-shaped cutout 111 may be formed at one or more corners of fence brace member 101; in a preferred embodiment, v-shaped cutout 111 is formed at each of the four corners of fence brace member 101.

Fence brace member 102 is adapted for use with first horizontally oriented fence rail 42 and second horizontally oriented fence rail 72. Fence rail 42 and fence rail 72 are referred to as horizontally oriented because the respective fence rails are positioned so that they are wider than they are tall. Fence brace member 102 may include first fence rail brace member 32 forming first horizontal picket fastener slot 332, second fence rail brace member 62 forming second horizontal picket fastener slot 662, fence post brace member 52 forming vertical pocket fastener slot 555, one or more fastener holes 8, and may form one or more v-shaped cutout 122. V-shaped cutout 122 may be formed at one or more corners of fence brace member 102; in a preferred embodiment, v-shaped cutout 122 is formed at each of the four corners of fence brace member 102.

Figure 6:
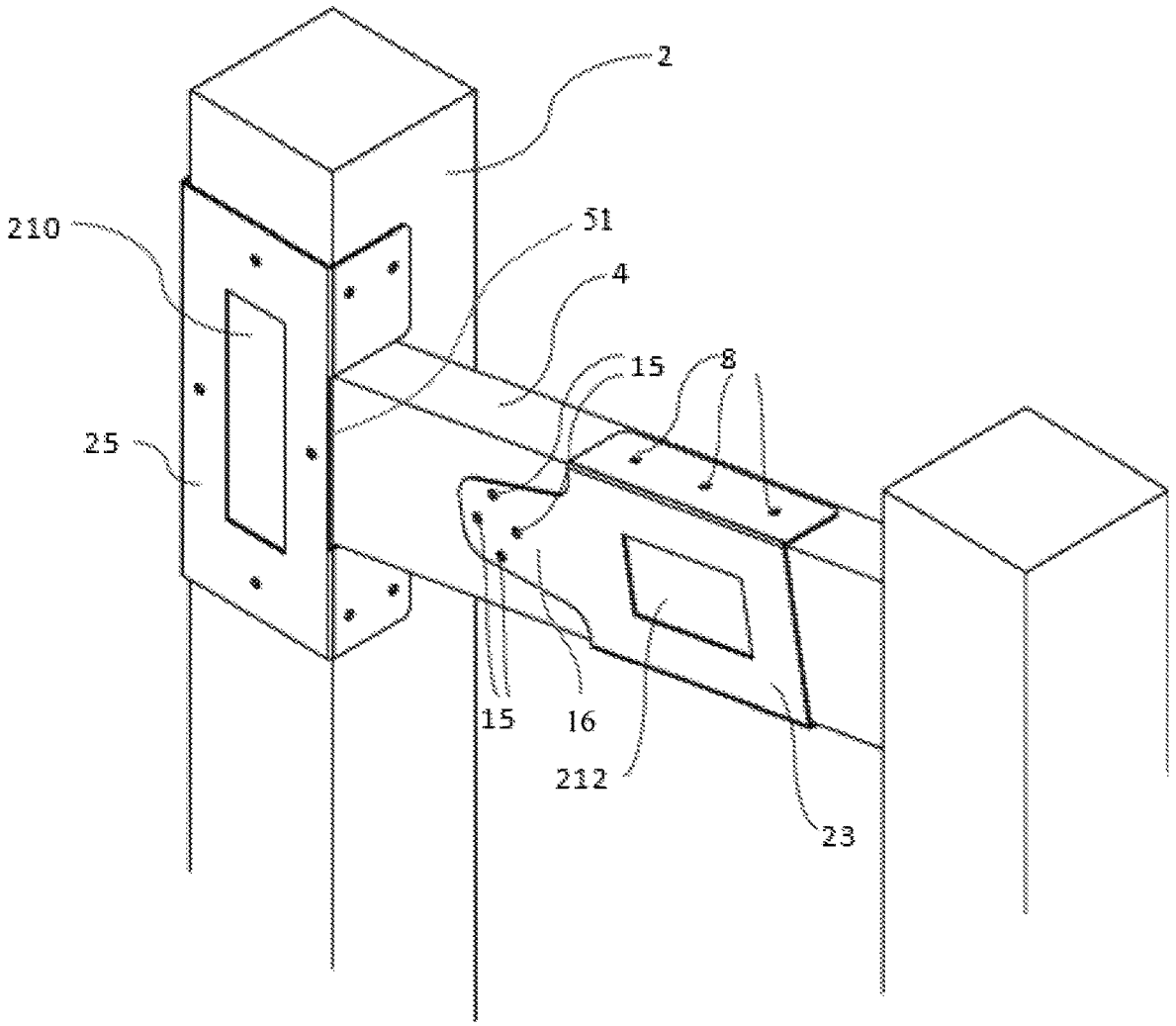
FIG. 6 illustrates an isometric view of an alternative embodiment of a fence assembly adapted for use to support a connection between a rectangular fence rail and a rectangular fence post disposed on a slope and depicted prior to the brace being secured, in accordance with the present invention.
Figure 7:
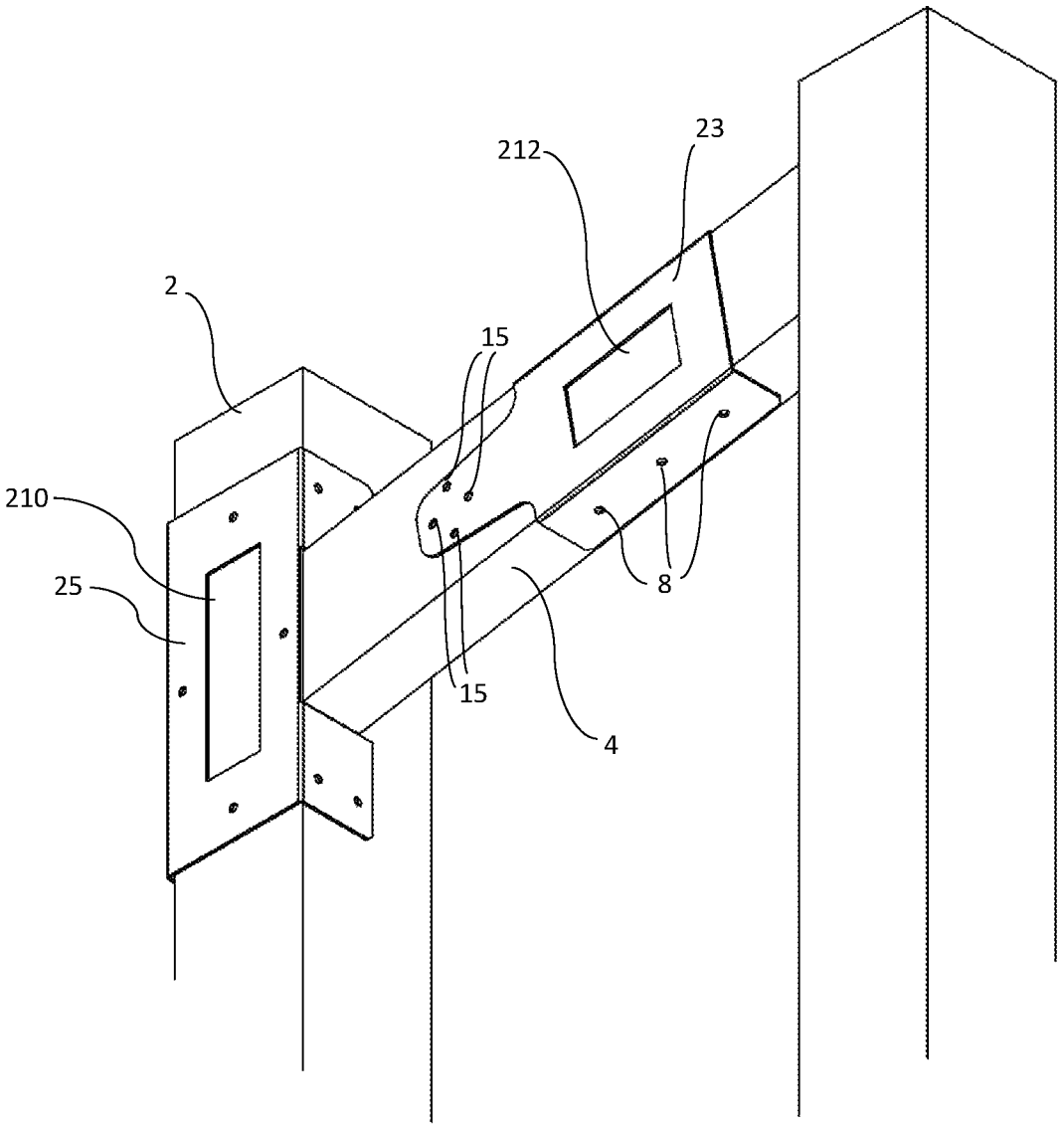
FIG. 7 illustrates an alternate isometric view of the alternative embodiment depicted in FIG. 6 of a fence assembly adapted for use to support a connection between a rectangular fence rail and a rectangular fence post disposed on a slope and depicted prior to the brace being secured, in accordance with the present invention.

Referring to FIG. 6, an alternative embodiment of the fence assembly adapted for use with one or more fence posts positioned on a slope is illustrated. The embodiments depicted in FIG. 6, FIG. 7, FIG. 8, and FIG. 9 are shown before fence rail brace member 23 is secured to fence post 2. The embodiments depicted in FIG. 10, FIG. 11, FIG. 12, and FIG. 13 are shown after fence rail brace member 23 is secured to fence post 2. Fence rail brace member 23 may be secured to fence post 2 by sliding a flap portion, or "flap", 16 of fence rail brace member 23 underneath fence post brace member 25 and securing fence rail brace member 23 to fence post 2 via a fastener passed through fastener hole 15 of fence rail brace member 23 and into fence post 2.

In this alternative embodiment (and similar alternative embodiments wherein the fence post member 25 forms notch 51 as illustrated in FIG. 10 through FIG. 13), the fence brace assembly includes fence post 2 having a rectangular cross-section, fence post rail 4 having a rectangular cross-section, fence post brace member 25 forming vertical picket fastener slot 210 and one or more fastener holes 15 (which may be referred to as screw holes), and fence rail brace member 23 forming horizontal picket fastener slot 212, one or more fastener holes 15 (which may be referred to as screw holes), and a plurality of sidewall fastener holes 8 for receiving additional fasteners.

An exemplary embodiment of fence post brace member 25 may include a pair of upper and lower fence post flanges wherein each of the fence post flanges have a planar central wall and a pair of rearward-protruding side walls extending along opposing vertical longitudinally-extending edges of the central wall. In this example of the herein disclosed brace system, the sidewalls of the upper fence post flange may be vertically-aligned with the sidewalls of the lower fence post flange to define a pair of aligned channels for receiving fence post 2 therein.

Figure 8:
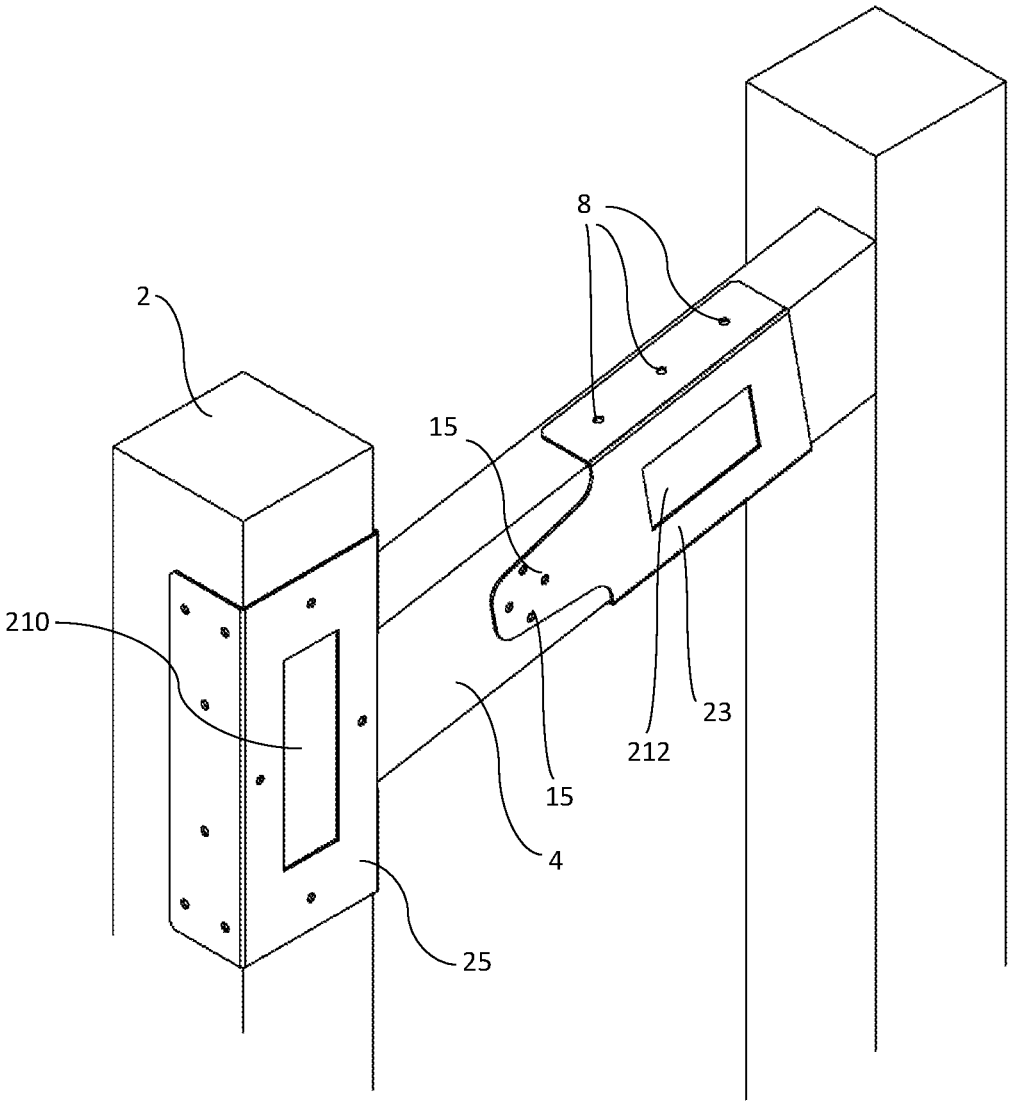
FIG. 8 illustrates a reverse isometric view of the alternative embodiment depicted in FIG. 6 of a fence assembly adapted for use to support a connection between a rectangular fence rail and a rectangular fence post disposed on a slope and depicted prior to the brace being secured, in accordance with the present invention.
Figure 9:
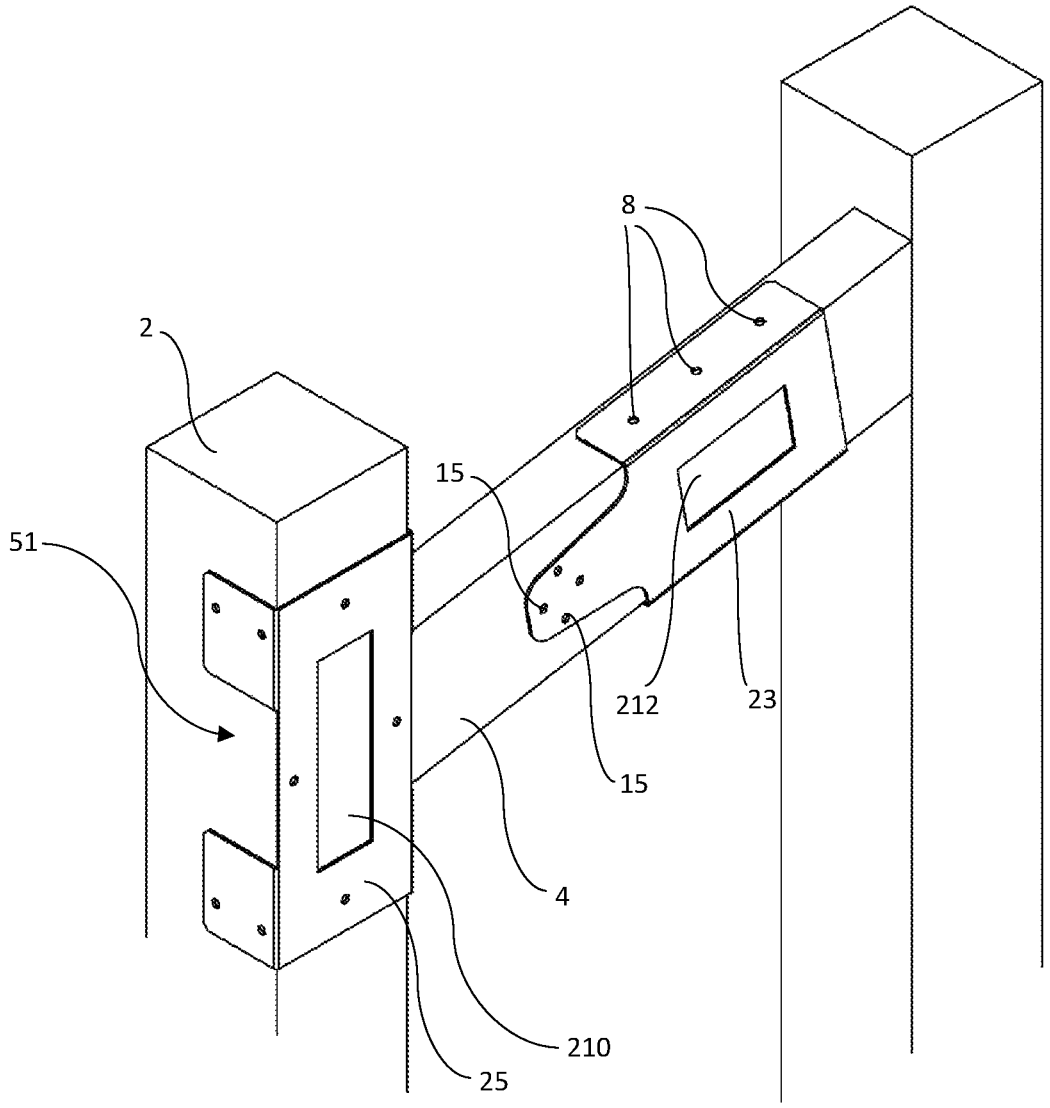
FIG. 9 illustrates a reverse isometric view of the alternative embodiment depicted in FIG. 6 of a fence assembly adapted for use to support a connection between a rectangular fence rail and a rectangular fence post disposed on a slope and depicted prior to the brace being secured, wherein the fence post brace forms a notch, in accordance with the present invention.
Figure 10:
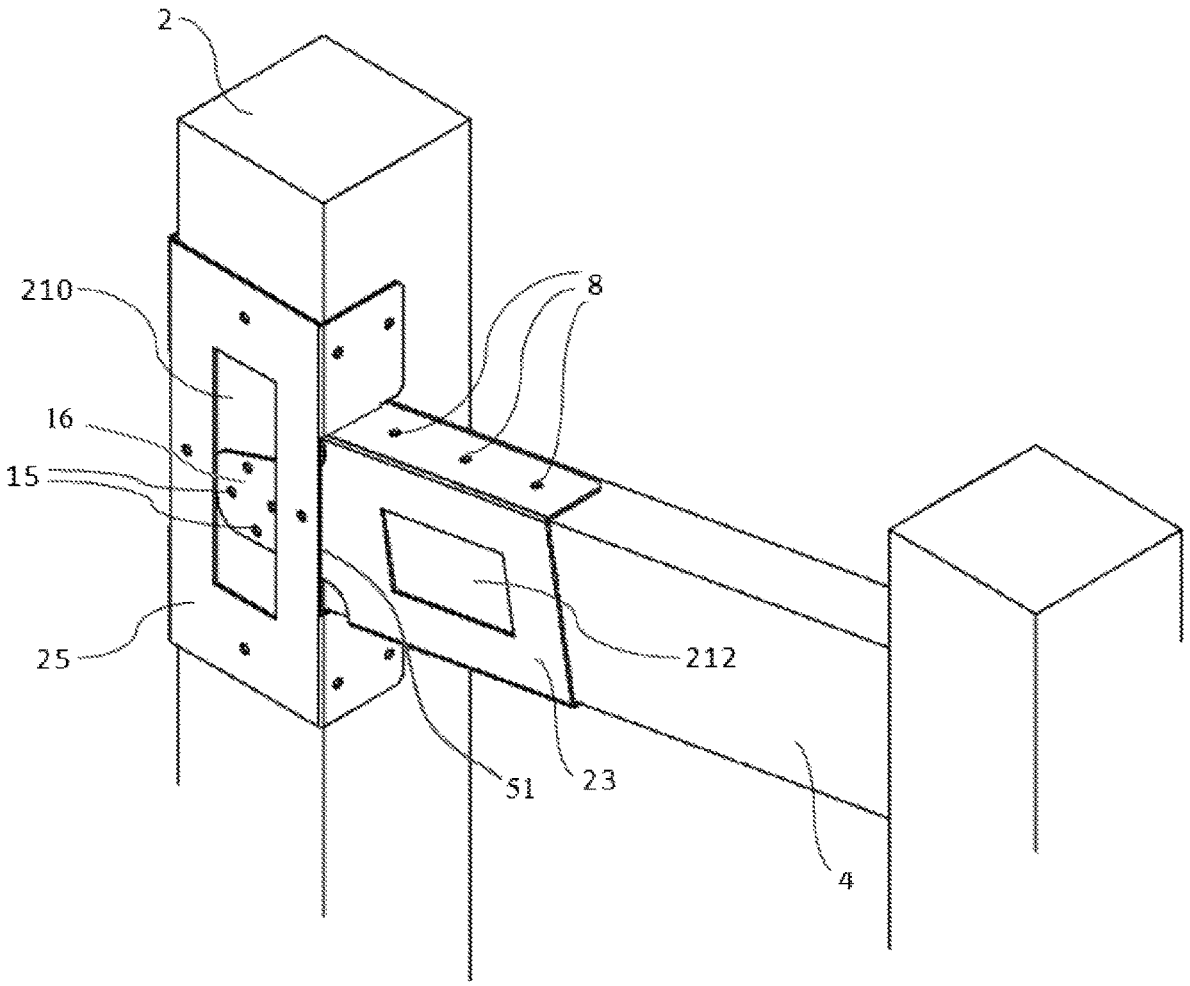
FIG. 10 illustrates an isometric view of the alternative embodiment depicted in FIG. 6 of a fence assembly adapted for use to support a connection between a rectangular fence rail and a rectangular fence post disposed on a slope and depicted after the brace has been secured, in accordance with the present invention.
Figure 11:
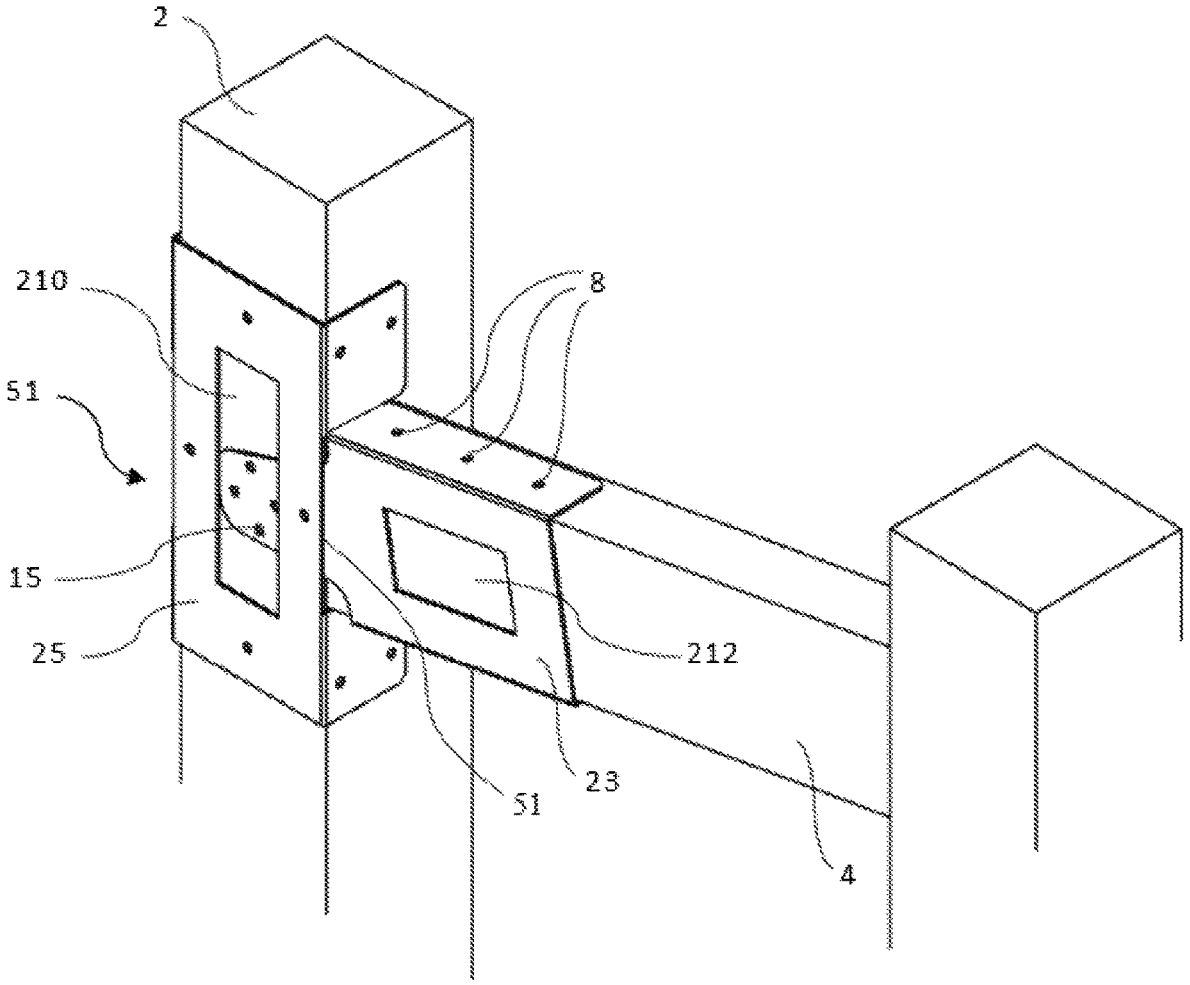
FIG. 11 illustrates an isometric view of the alternative embodiment depicted in FIG. 6 of a fence assembly adapted for use to support a connection between a rectangular fence rail and a rectangular fence post disposed on a slope and depicted after the brace has been secured, wherein the fence post brace forms a notch, in accordance with the present invention.
Figure 12:
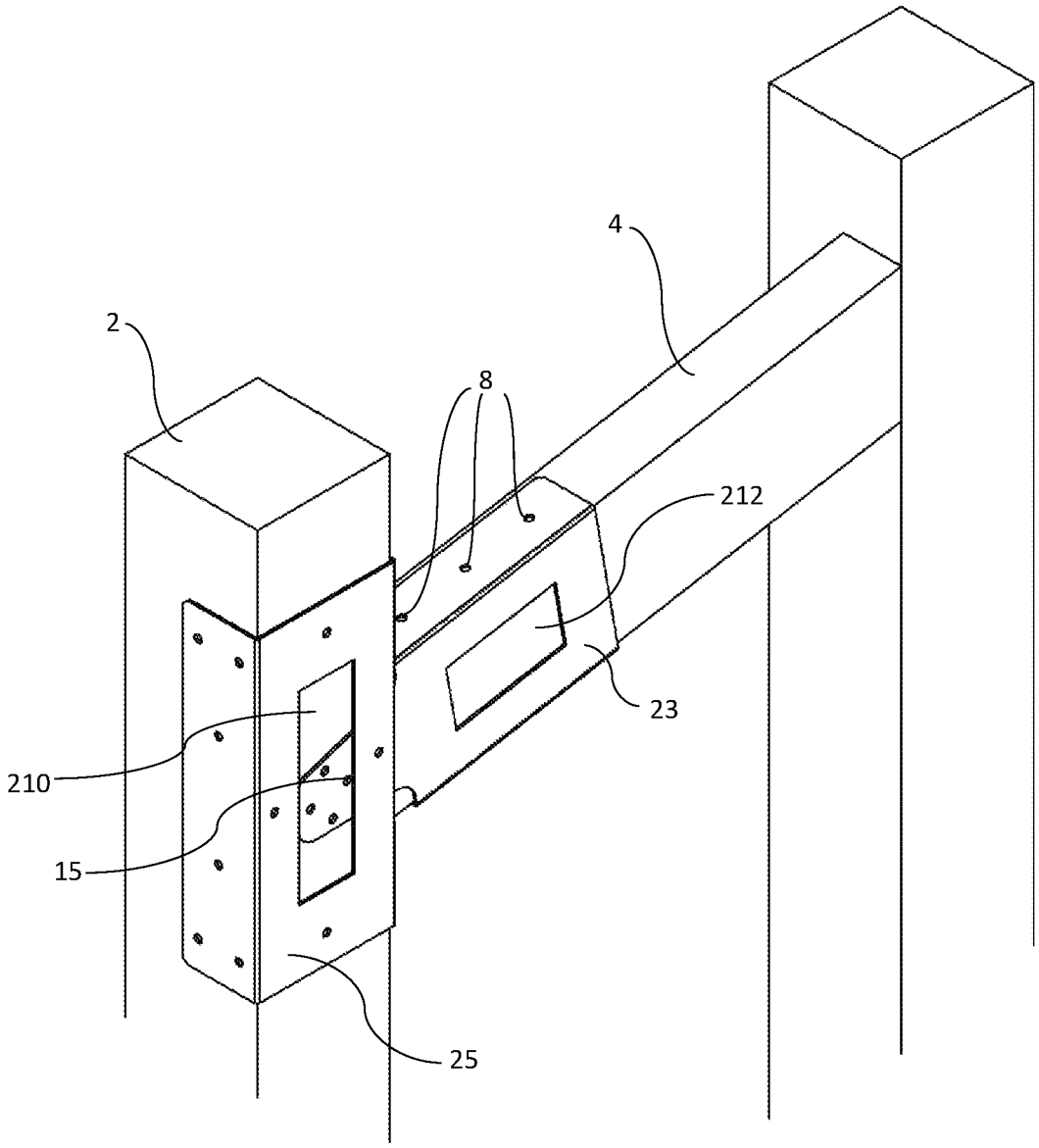
FIG. 12 illustrates a reverse isometric view of the alternative embodiment depicted in FIG. 6 of a fence assembly adapted for use to support a connection between a rectangular fence rail and a rectangular fence post disposed on a slope and depicted after the brace has been secured, in accordance with the present invention.
Figure 13:
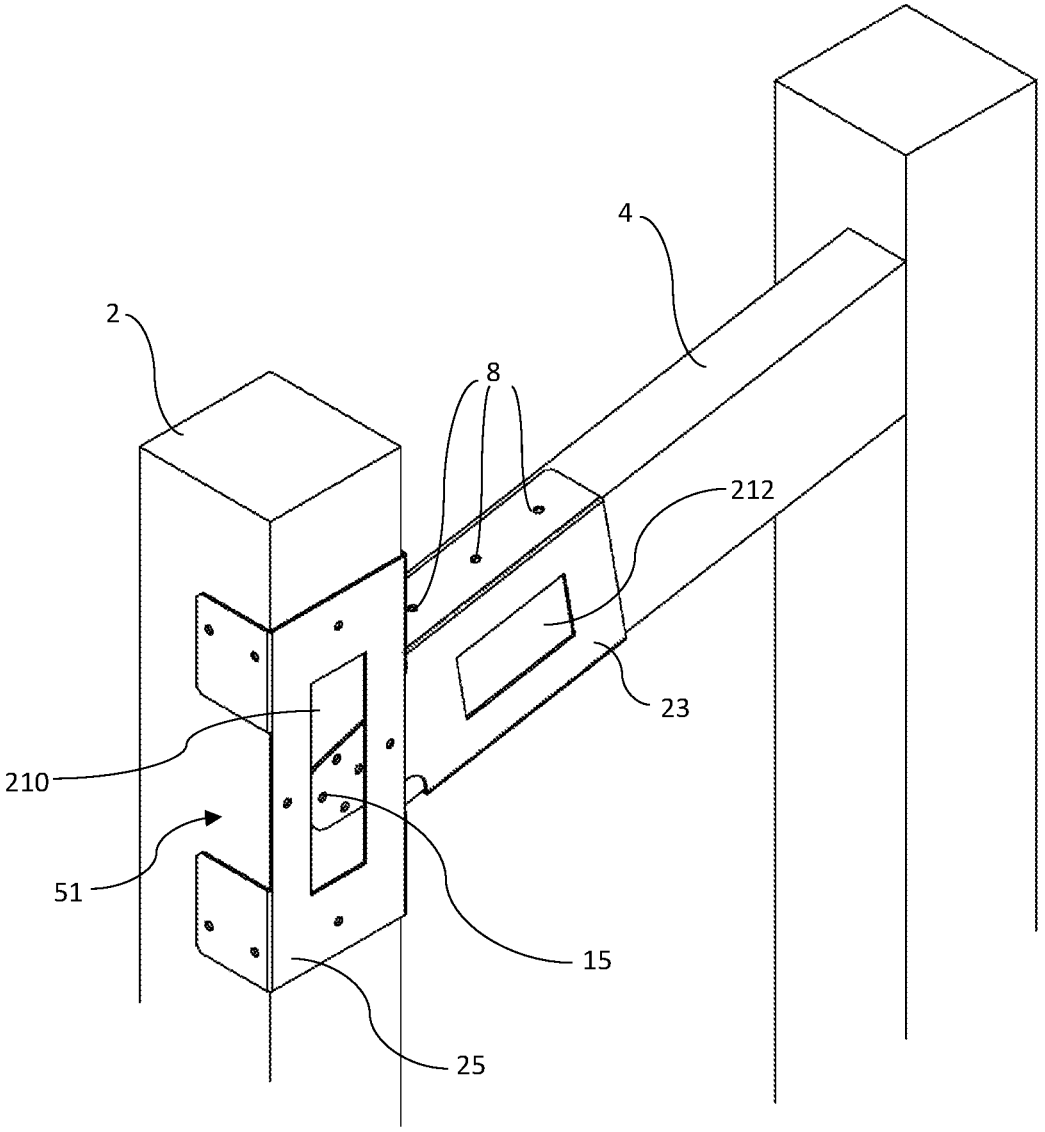
FIG. 13 illustrates a reverse isometric view of the alternative embodiment depicted in FIG. 6 of a fence assembly adapted for use to support a connection between a rectangular fence rail and a rectangular fence post disposed on a slope and depicted after the brace has been secured, wherein the fence post brace forms a notch or a notch on each side, in accordance with the present invention.

As seen in FIG. 8 and FIG. 12, the rearward-protruding sidewall of fence post brace member 25 may be continuous so as to cover an edge of fence post 2 entirely along fence post brace member 25. Alternatively, as seen in FIG. 9 and FIG. 13, the rearward-protruding sidewall of fence post brace member 25 may form notch 51.

An exemplary embodiment of fence rail brace member 23 may include a planar central wall and a pair of rearward-protruding walls extending along opposing horizontal longitudinally-extending edges of the central wall. In this example of the herein disclosed brace system, the walls of the fence rail flange may be horizontally-aligned to define a channel for receiving fence rail 4 therein. The rearward-protruding walls may form a plurality of fastener holes 8 for receiving one or more fasteners, such as a screw, to secure fence rail brace member 23 to fence rail 4. The planar central wall may form one or more fastener holes 15 for receiving one or more fasteners, such as a screw, to secure fence rail brace member 23 to fence post 2.

Fence post brace member 25 may form vertical picket fastening slot 210 for receiving a fastener which has passed through a picket to secure the picket to fence post 2 through vertical picket fastening slot 210. Picket fastening slot 210 may extend through the central planar wall of fence post brace member 25 and into both the upper fence post flange and the lower fence post flange. Fence rail brace member 23 may also form horizontal picket fastening slot 212 for receiving a fastener which has passed through a picket to secure the picket to fence rail 4 through horizontal picket fastening slot 212.

While the present invention has been illustrated and described herein in terms of a preferred embodiment and several alternatives, it is to be understood that the devices, systems, and assemblies described herein can have a multitude of additional uses and applications. Accordingly, the invention should not be limited to just the particular description and various drawing figures contained in this specification that merely illustrate a preferred embodiment and application of the principles of the invention.

What is claimed is:

1. A fence assembly comprising:

a fence post having a rectangular cross-section;

a fence rail having a rectangular cross-section;

a fence post brace member comprising:

a pair of opposing upper and lower fence post flanges, each of the fence post flanges comprising a planar central wall and a rearward-protruding side wall extending along a vertical longitudinally-extending edge of the central wall, the sidewall of the upper fence post flange being vertically-aligned with and spaced from the sidewall of the lower fence post flange to form a notch therebetween, and a plurality of fastener holes disposed within the central wall and the rearward-protruding side wall of each fence post flange for receiving one or more fasteners to secure the fence post therewith;

a planar central portion of the fence post brace member disposed between and formed with the central walls of the upper and lower fence post flanges, the planar central portion and the central walls of the upper and lower fence post flanges being formed from a single planar piece of material; and a vertical picket fastener slot longitudinally-extending through the central portion of the fence post brace member for receiving a fastener therethrough to affix a picket to the fence post with the fence post brace member therebetween; and a fence rail brace member comprising:

a fence rail flange comprising a planar central wall and a pair of rearward-protruding walls extending along opposing horizontal longitudinally-extending edges of the central wall, the walls of the fence rail flange being aligned to define a channel for receiving the fence rail therein, and a plurality of fastener holes disposed within the central wall and rearward-protruding walls of the fence rail flange for receiving fasteners to secure the fence rails therewith;

a horizontal picket fastener slot longitudinally extending through the planar central wall for receiving a fastener therethrough to affix a picket to the fence rail with the fence rail brace member therebetween; and a flap of the fence rail brace member extending along a latitudinally extending edge of the central wall, a plurality of fastener holes disposed within the flap of fence rail brace member;

wherein the flap of the fence rail brace member may be inserted into the notch of the fence post brace member, positioned behind the vertical picket fastener slot and between the fence post and the fence post brace member and secured to the fence post by receiving one or more fasteners through one or more of the flap of the fence rail brace member fastener holes.

2. The fence assembly of claim 1, wherein the fence post brace member and the fence rail brace member are made of a material selected from the group consisting of steel, stainless steel, galvanized steel, aluminum, plastic, graphite, and a composite material.

3. The fence assembly of claim 1, further comprising at least one picket, wherein the picket is fastened to the fence post by passing a fastener through the picket and through the vertical picket fastener slot and into the fence post.

4. The fence assembly of claim 1, further comprising at least one picket, wherein the picket is fastened to the fence rail by passing a fastener through the picket and through the horizontal picket fastener slot and into the fence rail.

5. The fence assembly of claim 1, further comprising a continuous rearward-protruding sidewall extending along a vertical longitudinally-extending edge of the fence post brace member opposing the upper and lower fence post flange rearward-protruding sidewalls, and a plurality of fastener holes disposed within the continuous rearward-protruding sidewall for receiving one or more fasteners to secure the fence post therein.

6. The fence assembly of claim 5, wherein the continuous rearward-protruding sidewall, the upper and lower fence post flanges and planar central wall, and the opposing the upper and lower fence post flange rearward-protruding sidewalls define a channel for receiving a fence post therein.

7. The fence assembly of claim 1, further comprising a second upper rearward protruding-sidewall and a second lower rearward-protruding sidewall extending along a vertical longitudinally-extending edge of each of the upper and lower fence post flange planar central walls to form a second notch opposing the notch formed by the upper and lower fence post flange rearward-protruding sidewalls, and a plurality of fastener holes disposed within the second upper and lower rearward protruding sidewalls for receiving one or more fasteners to secure the fence post therein.

8. The fence assembly of claim 7, wherein the upper and lower fence post flange rearward-protruding sidewalls, the upper and lower fence post flanges and planar central wall, and the second upper and second lower rearward-protruding fence post flange sidewalls defining a channel for receiving a fence post therein.

9. A fence assembly comprising:

a fence post having a rectangular cross-section;

a fence rail having a rectangular cross-section;

a fence post brace member comprising:

a pair of opposing upper and lower fence post flanges, each of the fence post flanges comprising a planar central wall and a rearward-protruding side wall extending along a vertical longitudinally-extending edge of the central wall, the sidewall of the upper fence post flange being vertically-aligned with and spaced from the sidewall of the lower fence post flange to form a notch therebetween, and a plurality of fastener holes disposed within the central wall and the rearward-protruding side wall of each fence post flange for receiving one or more fasteners to secure the fence post therewith;

a planar central portion of the fence post brace member disposed between and formed with the central walls of the upper and lower fence post flanges, the central portion and the central walls of the upper and lower fence post flanges being formed from a single planar piece of material; and a vertical picket fastener slot longitudinally-extending through the central portion of the fence post brace member for receiving a fastener therethrough to affix a picket to the fence post with the fence post brace member therebetween; and a fence rail brace member comprising:

a fence rail flange comprising a planar central wall and a pair of rearward-protruding walls extending along opposing horizontal longitudinally-extending edges of the central wall, the walls of the fence rail flange being aligned to define a channel for receiving the fence rail therein, and a plurality of fastener holes disposed within the central wall and rearward-protruding walls of the fence rail flange for receiving fasteners to secure the fence rails therewith;

a horizontal picket fastener slot longitudinally extending through the planar central wall for receiving a fastener therethrough to affix a picket to the fence rail with the fence rail brace member therebetween; and a flap portion of the fence rail brace member extending along a latitudinally extending edge of the central wall, a plurality of fastener holes disposed within the flap portion of fence rail brace member;

wherein the flap portion of the fence rail brace member may be inserted into the notch of the fence post brace member, positioned behind the vertical picket fastener slot and between the fence post and the fence post brace member and secured to the fence post by receiving one or more fasteners through one or more of the flap portion of the fence rail brace member fastener holes.

10. The fence assembly of claim 9, wherein the fence post brace member and the fence rail brace member are made of a material selected from the group consisting of steel, stainless steel, galvanized steel, aluminum, plastic, graphite, and a composite material.

11. The fence assembly of claim 9, further comprising at least one picket, wherein the picket is fastened to the fence post by passing a fastener through the picket and through the vertical picket fastener slot and into the fence post.

12. The fence assembly of claim 9, further comprising at least one picket, wherein the picket is fastened to the fence rail by passing a fastener through the picket and through the horizontal picket fastener slot and into the fence rail.

13. The fence assembly of claim 9, further comprising a continuous rearward-protruding sidewall extending along a vertical longitudinally-extending edge of the fence post brace member opposing the upper and lower fence post flange rearward-protruding sidewalls, and a plurality of fastener holes disposed within the continuous rearward-protruding sidewall for receiving one or more fasteners to secure the fence post therein.

14. The fence assembly of claim 13, wherein the continuous rearward-protruding sidewall, the upper and lower fence post flanges and planar central wall, and the opposing the upper and lower fence post flange rearward-protruding sidewalls define a channel for receiving a fence post therein.

15. The fence assembly of claim 9, further comprising a second upper rearward protruding sidewall and a second lower rearward-protruding sidewall extending along a vertical longitudinally-extending edge of each of the upper and lower fence post flange planar central walls to form a second notch opposing the notch formed by the upper and lower fence post flange rearward-protruding sidewalls, and a plurality of fastener holes disposed within the second upper and lower rearward protruding sidewalls for receiving one or more fasteners to secure the fence post therein.

16. The fence assembly of claim 15, wherein the upper and lower fence post flange rearward-protruding sidewalls, the upper and lower fence post flanges and planar central wall, and the second upper and second lower rearward-protruding fence post flange sidewalls defining a channel for receiving a fence post therein.

* * * * *